United States Patent [19]

Grunes et al.

[11] 4,393,663

[45] Jul. 19, 1983

[54] TWO-PHASE THERMOSYPHON HEATER

[75] Inventors: Howard E. Grunes; Dennis J. Morrison, both of Santa Cruz, Calif.

[73] Assignee: Gas Research Institute, Chicago, Ill.

[21] Appl. No.: 253,817

[22] Filed: Apr. 13, 1981

[51] Int. Cl.[3] ..... F25D 15/00

[52] U.S. Cl. ..... 62/119; 62/511; 165/104.21

[58] Field of Search ..... 62/119, 511; 165/104.21

[56] References Cited

U.S. PATENT DOCUMENTS

| | | | |
|---|---|---|---|
| 308,197 | 11/1884 | Rober . | |
| 705,167 | 7/1902 | Walker . | |
| 2,122,821 | 7/1938 | Mohr | 126/427 |
| 2,356,607 | 8/1944 | O'Brien | 165/104.21 |
| 2,499,736 | 3/1950 | Afkleen | 62/119 |
| 2,845,472 | 7/1958 | Narbutovskih | 62/119 |
| 2,947,150 | 8/1960 | Roeder, Jr. | 165/104.21 |
| 3,112,890 | 12/1963 | Snelling | 62/119 |
| 3,448,792 | 6/1969 | Lawrence | 165/1 |
| 3,854,454 | 12/1974 | Lazaridis | 122/33 |
| 3,864,938 | 2/1975 | Hayes, Jr. | 62/511 |
| 4,003,367 | 1/1977 | Wikholm | 126/271 |

*Primary Examiner*—Ronald C. Capossela

*Attorney, Agent, or Firm*—Limbach, Limbach & Sutton

[57] ABSTRACT

An apparatus for transferring heat from a heat source to a heat sink using a vaporizable liquid wherein the vaporizable liquid is heated in an evaporator so that some of the liquid vaporizes to propel the remaining heated liquid to a condenser, where heat is transferred from the heated liquid to the condenser predominantly by forced convection, and wherein the cooled liquid and condensed vapor are returned to the evaporator for reheating, and further wherein a restriction is disposed in the liquid/condensate return path to prevent vapor from the evaporator from flowing to the condenser through the return path.

12 Claims, 4 Drawing Figures

TWO-PHASE THERMOSYPHON HEATER

BACKGROUND OF THE INVENTION

The present invention is directed, generally, to heat transfer apparatus and, in particular, to a two-phase thermosyphon heat transfer apparatus.

In the past, heat pipe apparatus have been disclosed wherein the heat transfer fluid takes on two different phases, a vapor phase and a liquid phase. Heat transfer is accomplished using the latent heat carried by the vapor phase of the heat transfer liquid, while the liquid phase of the heat transfer liquid is utilized primarily as a means for returning the condensed vapor to the heat source. Typical of these efforts is Lazaridis, U.S. Pat. No. 3,854,454. In Lazaridis, water is heated to form a vapor, which then rises into a condenser chamber. The heated water vapor condenses on the walls of the condenser chamber thereby transferring heat from the vapor to the walls of the condenser chamber. The condenser chamber is positioned so that the condensed water is induced by gravity or a wick to flow back to the heat source portion of the heat pipe. In Lazaridis, the heat pipe is an L-shaped member with the horizontal portion being the heat source area, and the vertical portion being the condenser chamber. The heated water vapor rises from the horizontal leg and up into the condenser chamber. The cooled condensate flows down along the walls of the condenser chamber and back into the heat source area.

It is popularly believed that heat transfer in a heat pipe of this type is most efficient when heat is transferred by way of a vapor-to-liquid phase change heat transfer. In the present invention it has been discovered that heat transfer performance as high as, or better than, the apparatus of the prior art can be achieved without using the vapor-to-liquid heat transfer mechanism as the only heat transfer mechanism.

One significant drawback to using a single conduit vapor-to-liquid phase change technique as above is that condensed liquid returning to the evaporator section can be entrained by vapor flowing in the opposite direction. This can cause the evaporator to dry out and prevent effective heat transfer. To avoid this, vapor velocities must be kept low which, in turn, requires large diameter conduits.

Another drawback is that the condensed liquid which flows down the sides of the condenser chamber acts as a barrier between the heated vapor and the cooler wall of the condenser chamber. This layer of condensate has a thermal conductivity which is significantly lower than that for the wall of the condenser chamber. As such, the efficiency of the heat transfer between the vapor and the condenser chamber wall is reduced by the presence of the thick condensate layer.

Pumped-liquid loops have also often been used to transfer heat from a heat source to a heat sink, as in "side arm" domestic water heaters. These require the added expense of a pump and, in the presence of hard water, lead to scale formation on internal surfaces. Heat leaks can be significant when the device is turned off, and, upon turning off, significant amounts of heat can also be lost due to the cooling of the pump, the heat source components, and the liquid contained in the heat source components.

SUMMARY OF THE INVENTION

The foregoing and other problems of prior art heat transfer apparatus are overcome by the present apparatus for transferring heat from a heat source to a heat sink using a vaporizable liquid, the apparatus including evaporator means which are located at the heat source for heating the vaporizable liquid to produce a moving stream of a heated liquid-vapor mixture. Condenser means which have an inlet and an outlet are located at the heat sink. The inlet of the condenser means is communicatively coupled to the evaporator means for receiving the heated liquid-vapor mixture. The condenser means extract both sensible and latent heat from the heated mixture and condense the vapor portion of the mixture. The outlet of the condenser means is communicatively coupled to the evaporator means for returning the liquid mixture to the evaporator for reheating. Included within the condenser means are means for restricting the flow of the vapor for passing from the evaporator means through the outlet of the condenser to the condenser means.

In the present invention the predominant heat transfer mechanism is heated-liquid forced convection, with such mechanisms as "pool boiling" and "film condensation" playing a lesser role. High velocity vapor provides the pumping mechanism by which the heated liquid-vapor mixture is pumped from the evaporator and into the condenser to provide for forced convection heat transfer between the heated liquid and the condenser. Since vapor and liquid move together in the same direction, entrainment of liquid does not prevent condensate from returning to the evaporator. To the contrary, entrainment is, in fact, the mechanism by which the heated liquid is propelled to the condenser. Entrainment caused by high vapor velocities is beneficial since it enhances the thermosyphon pumping mechanism by delivering liquid to the condenser. A column of many inches of condensate can be established in the condensate return line providing the pumping head to power the flow mechanism and to produce the high-vapor velocities. Hence, small-flow conduits can be used for high heat-transfer rates. When heated liquid is used as the heat transfer medium as in the present invention, the problem of a thick barrier layer of condensate is thereby reduced. The flow of heated liquid over the condenser walls causes any cooler liquid layer adjacent to the walls of the condenser to mix with the heated liquid thereby reducing greatly the thermal resistance of the condensate layer.

When the apparatus is turned off, the condensate drains fully into the evaporator. Hence, one has a thermodiode similar to a heat pipe with gravity condensate return in which the heat transfer performance is very high in one direction, but heat losses are negligible in the opposite direction. Since no pump is used, and the amount of vaporizable liquid used is very small, very little heat is lost when the device is turned off and the parts close to the heat source are allowed to cool.

It is therefore an object of the present invention to provide an apparatus for transferring heat from a heat source to a heat sink wherein the heat transfer to the heat sink is by forced convection from a heated liquid and further wherein heated vapor serves as a pump to circulate the heated liquid through the apparatus and contributes to heat transfer through vapor-to-liquid phase change.

It is a further object of the present invention to provide an apparatus for transferring heat from a heat source to a heat sink wherein a condenser and an evaporator are connected in a loop so that heated liquid is pumped by high velocity vapor, from the evaporator to the condenser, through the supply leg of the loop and cooled liquid and condensed vapor are returned from the condenser to the evaporator by gravity, or other means, in the return leg of the loop.

It is a still further object of the present invention to provide an apparatus for transferring heat from a heat source to a heat sink which includes a restriction positioned in the return section of the circulating loop which prevents heated vapor and liquid from flowing to the condenser from the evaporator through the return leg of the loop.

It is another object of the present invention to provide a heat transfer apparatus for transferring heat between a heat source and a heat sink wherein heated liquid is pumped from an evaporator to a condenser by high velocity vapor and further wherein the apparatus has a heat transfer efficiency in excess of 80%.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
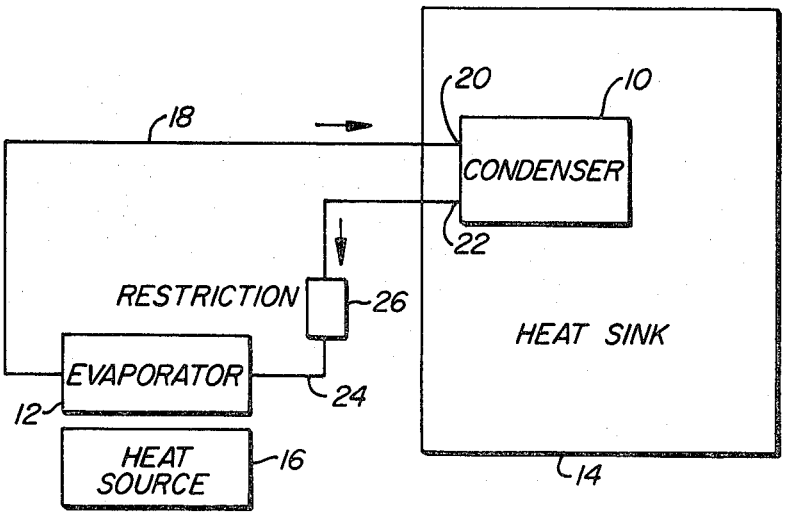
FIG. 1 is a simplified block diagram of the present invention.

Referring to FIG. 1, the elements of the present invention will be discussed. A condenser 10 and an evaporator 12 are connected to form a sealed loop. The condenser 10 is located within a heat sink 14, while the evaporator 12 is located externally to the heat sink 14. The evaporator 12 is positioned next to a heat source 16 so that heat may be transferred from the heat source 16 to the evaporator 12. A vaporizable liquid is circulated between the condenser 10 and the evaporator 12. The liquid is heated in the evaporator 12 and flows from the evaporator 12 into the inlet port 20 of the condenser 10 via supply pipe 18. The liquid is cooled in the condenser 10 and flows out of the condenser outlet 22 back to the evaporator 12 via a return pipe 24. Positioned within the return pipe 24 is a restriction 26 which restricts the flow of heated liquid and vapor from the evaporator 12 into the outlet 22 of the condenser 10.

Within the evaporator 12, the vaporizable heat transfer liquid is heated by the heat source 16 so that heated liquid and heated vapor are produced. The heated vapor provides the pumping mechanism by which the heated liquid is propelled through the supply pipe 18 to the condenser 10. The restriction 26 provides sufficient back pressure to the fluid flow from the evaporator to prevent heated liquid or vapor from flowing out of the evaporator, through the return pipe, and into the outlet 22 of the condenser 10.

Within the condenser 10, the heated liquid transfers heat to the walls of the condenser by forced convection. The heated vapor is also condensed, which provides some heat transfer. The cooled liquid and condensed vapor are then drawn, by gravity or otherwise, from the condenser 10 through the outlets 22 and back to the evaporator 12 via return pipe 24.

Figure 2:
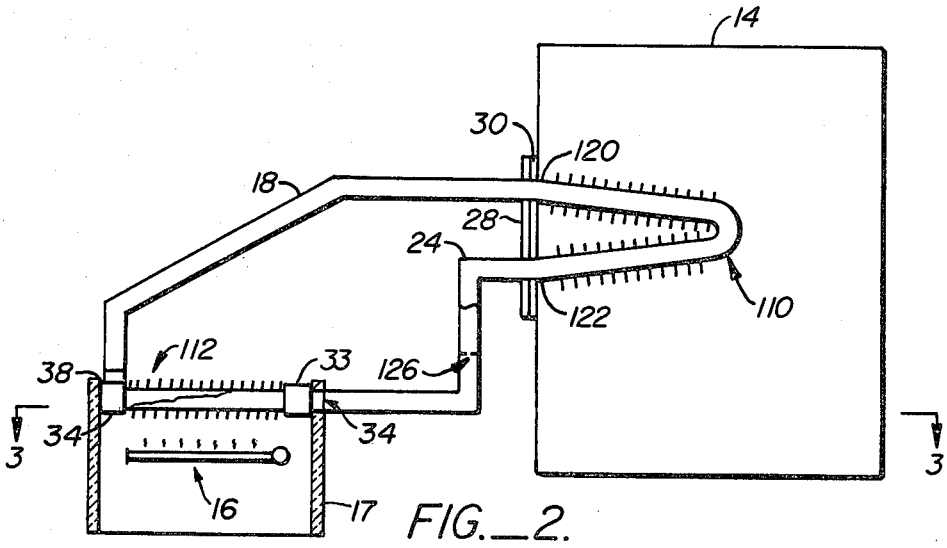
FIG. 2 is a cross-sectional view of the present invention.
Figure 3:
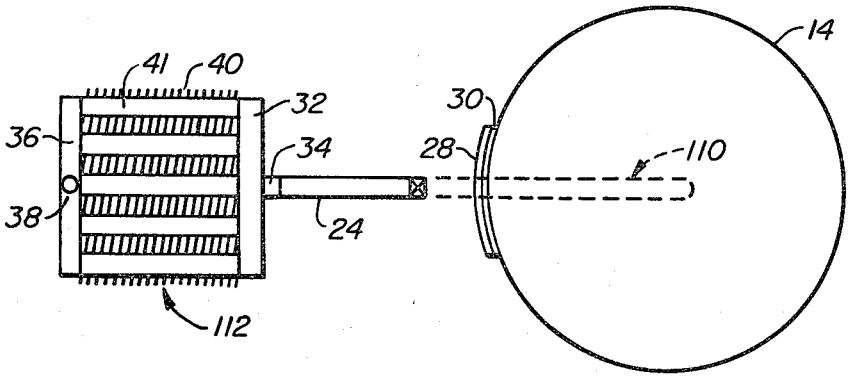
FIG. 3 is a diagram of the present invention taken along lines 3—3 of FIG. 2.

Referring more particularly to FIG. 2, the preferred embodiment of the present invention will now be described. In the preferred embodiment, the condenser 10 is a finned, hair-pin-shaped condenser 110. The hair-pin condenser 110 is positioned within the heat sink 14 so that one leg is located above the other leg. The upper leg serves as the inlet 120 to the hair-pin condenser 110 while the lower leg serves as the outlet 122. The hair-pin condenser 110 is held in place with a flange 28 which is bolted to the heat sink 14 with an intervening rubber gasket 30. This arrangement allows for the removal, cleaning or removal of scale, and repair or replacement of the hair-pin condenser 110. Both legs of the hair-pin condenser 110 are sloped to permit liquid flow from the upper leg through the lower leg.

In the preferred embodiment, the evaporator 12 is positioned below the hair-pin condenser 110 and includes a plurality of finned tubes 41 to form a multi-tube evaporator 112. The tubes 41 are arranged parallel to each other and communicatively coupled at one end by a header 32 which has an inlet port 34. The other ends of the finned tubes 41 are communicatively coupled together by a header 36 which has an outlet port 38. The fins 40 of the tubes 41 enhance the transfer of heat from the heat source 16 to the liquid contained within the multi-tube evaporator 112.

In the preferred embodiment of the present invention, the supply pipe 18 communicatively couples outlet port 38 of the multi-tube evaporator 112 to the inlet 120 of the hair-pin condenser 110. The supply pipe 18 first rises vertically from outlet port 38 of the multi-tube evaporator 112, then slopes upward toward the hair-pin condenser 110 before communicatively coupling with the upper leg 120 of the hair-pin condenser 110.

Figure 4:
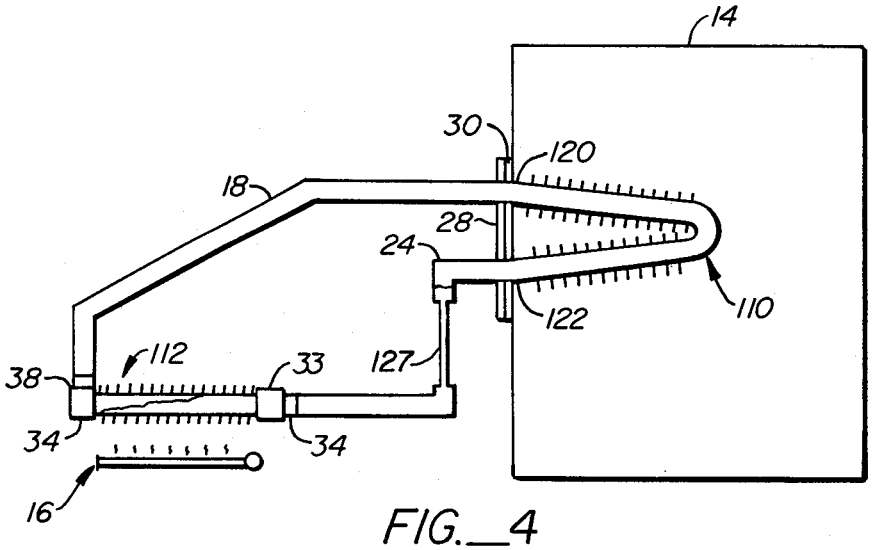
FIG. 4 is a diagram illustrating an alternate embodiment of the restriction.

In the preferred embodiment of the present invention, the return pipe 24 communicatively couples the outlet 122 of the hair-pin condenser 110 to the inlet 34 of the multi-tube evaporator 112. Positioned within the return pipe 24 is a restriction 126 which can be a structure having an orifice having a predetermined diameter, or a tube 127 having a predetermined inlet diameter (FIG. 4), for example. These diameters are selected to prevent vapor from traveling up the return pipe 24 from the multi-tube evaporator 112 to the hair-pin condenser 110 and to promote stable operation. In one embodiment of the invention, designed for a firing rate of 50,000 BTU/HR, an orifice having an diameter of approximately $\frac{1}{8}$ inch or a tube having an inner diameter of approximately 3/16 inch provides satisfactory operation of the apparatus when the inner diameter of the return pipe 24 is approximately one inch.

The finned tubes used in both the multi-tube evaporator 112 and the hair-pin condenser 110 of the above embodiment are approximately $\frac{7}{8}$ inch inner diameter, and the fins 40 are approximately $1\frac{7}{8}$ inch outer diameter, and spaced approximately 7 per inch. The evaporator has approximately five 7-inch long finned tubes. Outlet header 36 is rectangular in shape and has outside dimensions of approximately one inch by two inch. The inlet header 32 is also rectangular in shape and has outside dimensions of approximately one inch by one inch.

Each leg of the hair-pin condenser 110 is approximately 13 inches in length. In a further embodiment, two hair-pin-shaped tubes are manifolded together to form the hair-pin condenser 110.

In the preferred embodiment, the heat sink 14 is a tank of potable water, and the heat source 16 is a gas burner. It is to be understood that the apparatus of the present invention may be used with other heat sources, such as, an electrical element, wood or coal fired heat sources, or any of a variety of possible heat sources. Additionally, the heat sink 14 need not be a tank of potable water. For example, the heat sink 14 can be a tank of some other material, such as air which is to be heated, a room, or any of a number of applications which require the input of heat.

In the preferred embodiment of the present invention, the heat transfer liquid is water, however, other vaporizable liquids can be used with satisfactory results.

In operation, the multi-tube evaporator 112 performs much like a forced convection horizontal tube boiler, with a continuous throughput of both liquid and vapor. Within the evaporator, the mass fraction decreases in the direction of flow, and depending upon the operating conditions and evaporator tube geometry, bubble, plug, churn, annular, and mist flow regimes may be present. Under normal conditions, the liquid/vapor flow at the evaporator outlet 38 is annular, with a thick film traveling at high velocity through the supply pipe 18 all the way into the hair-pin condenser 110.

Heat transfer on the inside of the condenser is due to both forced convection and evaporation/condensation with the former dominating. Hence, the system is essentially a forced convection "loop" with the vapor serving as the "pump."

During proper operation of the present invention a column of water stands in the return pipe 24. This water column is equivalent to the pressure drop through the system. The size of the restriction 126, in part, determines the height of the water column, as do other component geometries, the firing rate, and the operating temperature.

In the 50,000 BTU/HR firing rate embodiment of the present invention, the multi-tube evaporator 112 is located approximately 12 inches below the hair-pin condenser 110. The entire flow loop is constructed of copper. Although the system can operate stably under a full vacuum, the addition of a small amount of noncondensable gas, for example, air, nitrogen, or argon, reduces the height of the water column in the return tube 24, thus enabling closer evaporator-condenser spacing and a lower heat transfer fluid volume. In the above embodiment of the present invention only approximately 200 cubic centimeters of water is required. With this volume of water, the evaporator tubes are less than one half filled thereby greatly reducing any potential damage due to freezing.

Experimental results have indicated that with the addition of a well insulated combustion chamber 17 about the multi-tube evaporator 112, firing efficiencies in excess of 80% (based upon the higher heating value of natural gas) can be achieved by the apparatus of the present invention, when fired with an atmospheric natural gas burner at a rate of 50,000 BTU/HR.

A method of transfering heat from a heat source to a heat sink comprises heating a vaporizable liquid in an evaporator so that some of the liquid is vaporized, propelling the heated, unvaporized liquid to a condenser with the pressure of the vaporized liquid, cooling the heated liquid and vapor in the condenser by transferring heat from the liquid and vapor to the heat sink, returning the cooled liquid and condensed vapor through a return pipe for further heating by the heat source, and creating a back-pressure in the return pipe to restrict the flow of vapor from the evaporator through the return pipe to the condenser.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. Apparatus for transferring heat from a heat source to a heat sink via a vaporizable liquid when the apparatus is operating, the apparatus comprising evaporator means at the heat source for heating the vaporizable liquid so that a portion of the liquid is vaporized to produce a moving stream of a heated liquid-vapor mixture;

condenser means at the heat sink, the condenser means having a inlet and an outlet, the inlet being communicatively coupled to the evaporator means for receiving the heated mixture, and wherein the condenser means extracts both sensible and latent heat from the heated mixture and condenses the vapor portion of the mixture back into liquid form, and wherein the outlet is communicatively coupled to the evaporator means for returning the cooled liquid and condensed vapor to the evaporator for reheating;

supply means for communicatively coupling the inlet of the condenser means to the evaporator means; and return means for communicatively coupling the outlet of the condenser means to the evaporator means, the return means further including restriction means for passing the cooled liquid and condensed vapor from the outlet of the condenser means to the evaporator means while impeding the flow of vapor from the evaporator means to the condenser means through the outlet of the condenser means by way of the return means when the apparatus is operating.

2. The heat transfer apparatus as recited in claim 1, wherein the condenser means are positioned at a higher elevation than the evaporator means.

3. The heat transfer apparatus as recited in claim 1, wherein the heat source is a gas burner and the heat sink is a fluid storage and supply tank.

4. The heat transfer apparatus as recited in claim 1, wherein the heat source is a an electric heating coil and the heat sink is a fluid storage and supply tank.

5. The heat transfer apparatus as recited in claim 1, wherein the vaporizable liquid mixture further includes a gas whose condensation temperature is below the operating temperatures of the system.

6. The heat transfer apparatus, as recited in claim 1, wherein the evaporator means comprise a plurality of finned tubes, each tube having an opened first end and second end, which are spaced apart and parallel to each other in a common plane, the plane being generally parallel to the heat source;

a first header having an inlet port and a plurality of coupling ports for communicatively coupling the inlet port to the first end of each tube; and a second header having an outlet port and a plurality of coupling ports for communicatively coupling the second end of each tube with the outlet port.

7. The heat transfer apparatus, as recited in claim 1, wherein the condenser means comprise a hair-pin shaped, finned, tubular member, having an upper leg and a lower leg, the end of each leg being open, the tubular member being disposed within the heat sink so that a free standing liquid will flow from the upper leg opening, through the upper leg, into the lower leg, and finally out of the lower leg opening.

8. The heat transfer apparatus, as recited in claim 1, including a return means for coupling the outlet of the condenser means to the evaporator means, the return means having a predetermined inner diameter, wherein the restriction means include a structure shaped for insertion into the return means and having an orifice, the orifice having a predetermined diameter, so that fluid flow through the return means is determined by the orifice diameter.

9. The heat transfer apparatus, as recited in claim 1, including a return means for coupling the outlet of the condenser to the evaporator, the return means having a predetermined cross-sectional area and wherein the restriction means are coupled within the return means and comprise a tube having a cross-sectional area which is smaller than the cross-sectional area of the return means.

10. Apparatus for heat transfer between a heat source and a water storage tank by way of a vaporizable liquid, comprising, a finned hair-pin shaped, tubular condenser having an upper leg and a lower leg, the condenser mounted within the storage tank with the upper leg disposed above the lower leg and so that both legs protrude through the storage tank wall to the exterior of the tank, the condenser being mounted to the storage tank so that both legs are sloped to permit liquid flow from the upper leg through the lower leg;

a multiple-tube evaporator suspended above the heat source and below the condenser;

a supply pipe communicatively coupled to the multiple-tube evaporator so that the supply pipe rises vertically from the evaporator and then slopes upward toward the condenser before communicatively coupling with the upper leg of the condenser;

a return pipe communicatively coupled to the lower leg of the condenser and to the evaporator; and a restriction disposed within the return pipe for regulating the flow of liquid and restricting the flow of vapor through the return pipe;

wherein the vaporizable liquid is heated in the multiple tube evaporator so that a portion of the liquid is vaporized to generate a high velocity vapor and further wherein the remaining unvaporized liquid is entrained by the vapor to form a heated liquid-vapor mixture which exits from the evaporator and is propelled by the vapor pressure through the supply pipe into the tubular condenser where the vapor is condensed to liquid and the mixture is cooled, the cooled liquid then flowing out of the lower leg of the condenser and into the return pipe for return to the multiple-type evaporator.

11. The heat transfer apparatus, as recited in claim 1, further wherein the evaporator means and the heat source are disposed in a well-insulated combustion chamber.

12. A method of transferring heat from a heat source to a heat sink, comprising the steps of heating a vaporizable liquid in an evaporator with the heat source so that some of the liquid is vaporized to generate high velocity vapor which entrains the remaining unvaporized liquid and provides vapor pressure to propel the heated mixture of vapor and liquid from the evaporator to a condenser;

cooling the heated liquid and vapor in the condenser by transferring heat from the liquid and vapor to the heat sink;

returning the cooled liquid and condensed vapor through a return pipe for further heating by the heat source; and providing a restriction means for creating a back-pressure in the return pipe to restrict the flow of vapor from the evaporator through the return pipe to the condenser.

* * * * *